United States Patent [19]

Sulkowski

[11] 4,290,480

[45] Sep. 22, 1981

[54] ENVIRONMENTAL CONTROL SYSTEM

[76] Inventor: Alfred Sulkowski, 4 Oak Dr., Marlboro, Conn. 06447

[21] Appl. No.: 18,847

[22] Filed: Mar. 8, 1979

[51] Int. Cl.[3] ..... F24F 3/14

[52] U.S. Cl. ..... 165/21; 62/176 D; 236/44 C

[58] Field of Search ..... 165/21; 62/90, 173, 62/176 D; 236/76, 44 C

[56] References Cited

U.S. PATENT DOCUMENTS

| | | | |
|---|---|---|---|
| 1,097,348 | 5/1914 | Murray | 236/76 X |
| 3,352,352 | 11/1967 | Walters | 165/21 X |
| 3,694,925 | 10/1972 | Coyle et al. | 165/21 X |
| 3,786,859 | 1/1974 | Day | 165/21 |
| 3,989,097 | 11/1976 | Schildknecht | 165/21 |
| 4,105,063 | 8/1978 | Bergt | 165/21 |

OTHER PUBLICATIONS

Environmental Control Panel Instructions, Hill Refrigeration Division, Emhart Industries, Inc., Trenton, N.J., Jan., 1978.

*Primary Examiner*—Albert W. Davis
*Assistant Examiner*—Margaret A. Focarino
*Attorney, Agent, or Firm*—Kane, Dalsimer, Kane, Sullivan & Kurucz

[57] ABSTRACT

An environmental control system controlling an air cooling means, a heat reclaiming means, fresh air supply, auxiliary heaters when necessary, and temperature and humidity sensors, all of which are coordinated by an environmental control panel. The panel would in addition to providing temperature regulation also control the humidity by overcooling the air by the A.C. reducing humidity and then using the reclaimed heat and/or auxiliary heat to heat the air to a desired level and would utilize individual-temperature calibrated-sensors to achieve exact control of steps signaled from control panel to heating and cooling equipment.

38 Claims, 4 Drawing Figures

ENVIRONMENTAL CONTROL SYSTEM

BACKGROUND OF THE INVENTION

1. Field of the Invention

The present invention relates to an environmental control system for the regulation of the temperature and humidity of air within a desired area.

2. Description of the Prior Art

There exists today a wide variety of products whose purpose is to provide a means of producing and maintaining a desired climatic condition in homes and businesses. This is usually accomplished by temperature and/or humidity sensitive devices signaling air conditioning or heater units to operate until a desired pre-set environment is attained.

While it is desirous to have a comfortable environment, with the cost of energy skyrocketing there is a general concern over the amount of energy wasted under present systems and efficiency and cost cutting means are more than ever being employed.

For example, in the home it is not necessary to maintain a set temperature 24 hours a day. Thermostats may be adjusted to a time sequence providing a cooler temperature at night in the winter months. The same is true for business perhaps to an even greater extent in facilities on the 9-to-5, 5-day work schedule.

Humidity control is less flexible than temperature. Important, however, is the coordinating the humidity control with the temperature control since the energy expended in temperature maintenance is directly affected by the amount of humidity in the air.

The combining and coordinating temperature and humidity control is not new and a number of examples may be found in the prior art. However, many of these systems utilize components and parts which are in developing stage or out-dated and no longer available, making them commercially unfeasible.

The environmental control systems presently on the market rely heavily upon electronic switching, requiring a relatively large number of moving complex parts with complicated adjustment. These are expensive to manufacture and assemble. Further, with the constant new developments, equipment is outdated in short time, and disappears from the market. Replacement of worn-out or defective parts involves a complicated, time-consuming procedure when available at all. This is aside from the inconvenience and expense incurrent when the system is inoperative.

There exists a need for a system which will be relatively simple and reliably accurate consisting of a minimum number of moving parts and parts which are commercially standard, easily acquired and replaced when necessary. As the consumer becomes more directly affected by the energy situation the demand exists for a system that will utilize to the fullest extent the energy used and is versatile enough to be adopted to the many different demands while remaining of relatively low cost.

SUMMARY OF THE INVENTION

It is a principal object of this invention to provide for an improved environmental control system which is accurate and comprised of a minimum number of moving parts, each part relatively simple, easy to adjust, and basically conventional providing for low cost manufacture, assembly and replacement when necessary.

Another object of this invention is to provide such a system which would allow for the reclaiming of heat, normally dissipated in the ambient by the air cooling means and utilize it as free heating energy for numerous purposes including the control of humidity.

A further object of this invention is to provide for a system which may readily be adapted to the various needs of the public, inexpensively, through the use of conventional parts.

These and other objectives may be achieved by the present invention. Aside from the important aspect of cutting material costs and simplifying its operation, the present system provides for the harvest waste energy from the compression cycle of the cooling and/or refrigerating means which is usually dissipated and lost.

This reclaimed energy can be used in a variety of ways, heating water for domestic purpose to be used in the home or business, or, as contemplated by the invention, used to control the temperature and the humidity in the air. Humidity control is not only desirable from a comfort stand point but also in many applications important in reducing the amount of energy expended in overall business operations. For example, in commercial applications, many businesses utilize refrigeration devices within the controlled environment such as supermarkets. When you reduce the humidity you reduce the refrigeration load requirement. A reduction of humidity is reducing the running time of the compressors operating equipment inside of controlled environment. In addition, you reduce the condensate and defrost heating requirement.

Condensate heating is required to remove the moisture build-up on lower temperatures which are in contact with the warmer ambient air. By reducing the humidity you reduce the amount of condensation on that surface, lessening the heating requirement and corresponding energy use. Similarly, the defrosting the ice build-up on cooling coils is provided by a heater. Air moisture reduction limits the ice build-up on the coils, thereby saving on the heaters required for operation time and respective energy use.

The basic system envisions the use of a cooling means, air conditioning hereafter (A.C.) and/or other refrigeration means, heat reclaiming means controlled by diverting valves, auxiliary heaters in addition to reclaimed heat when necessary and temperature and humidity sensors, all of which are controlled and coordinated by an environmental control panel with variations on a cyclic basis. The panel, in addition to providing temperature regulations, would also control the humidity by overcooling the air with the A.C. and then using the reclaimed heat from the A.C. or refrigeration units to heat the overcooled air to a desired level.

All of the temperature and humidity control would be inititated by the respective sensors located about the area to be regulated. By the use of a series of relays properly wired, the activities of the A.C. and heaters are coordinated with the sensors to produce the desired temperature and humidity levels. The result is that through the use of a minimum number of relatively simple standard parts accurate and effective environmental control is achieved.

The system is inexpensively adaptable to meet the various demands of the different commercial and private applications by the addition of relays, timers and sensors. Also, the supply fan may be regulated by the panel, which would supply air moving through the heating and/or air conditioning units on a continuous basis during the day. At night, the fan is deactivated, not only saving electric power, but the non-moving of air in the system will allow the creation of microclimates around refrigeration units, if any, providing further energy savings. The supply fan would be activated during nighttime operation only when required by the system as later discussed.

In addition, a fresh air louver and/or fresh air supply fan can be used which introduces fresh air in the system during daytime operation to prevent stale air odor, provide oxygen and also to pressurize the building. However, since fresh air is expensive in that it has to be conditioned, during nighttime operation it is deactivated by the panel as an added energy saver.

DETAILED DESCRIPTION OF THE DRAWINGS

Figure 1:
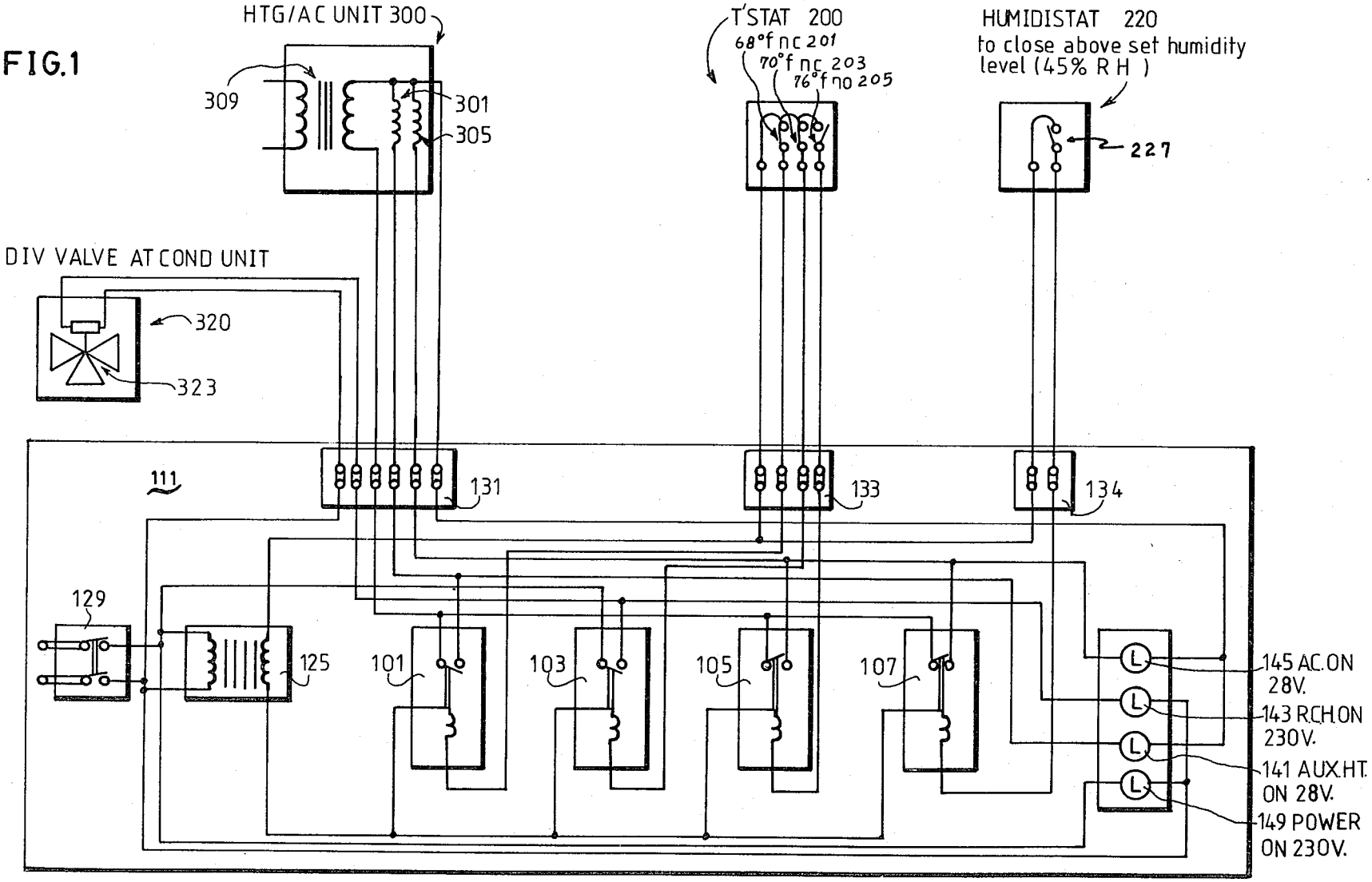
FIG. 1 is a schematic drawing of an environmental control system utilizing a single stage reclaim heat, single stage auxiliary heat and single stage A.C. control panel incorporating the teachings of this invention.

In regard now to FIG. 1, a schematic of a single stage environmental control system is shown. The basics of the system is a series of spring relays 101, 103, 105 and 107 contained in panel 111. Their function is to receive signals from the temperature sensor 200 and humidity sensor 220 and, based upon this, activate or deactivate the air heating or cooling means via terminal block 131 providing heating or cooling according to the existing environmental conditions. The system can best be described when in operation and as initial environmental conditions assume, as an example, the relative humidity is below 45% and the air temperature is below 68°. Note that parameters of the various elements have been listed on the drawings. These are used merely as examples so that the working of the device can most fully be understood. They are not in any way critical to the operation of the system, and as appreciated by those skilled in the art, may readily be varied as desired.

The panel is activated by an on/off switch 129 which when closed provides the system with power from an outside source. The A.C. and auxiliary heater control are supplied with their own source of power from transformer 309. The current entering the system activates indicator lamp 149 and energizes the transformer 125. The external power source can be 208 volts alternating current with a 208/24 volt transformer providing power to low voltage parts. The panel is readily adaptable to utilize voltage of a different characteristic when necessary by the substitution of parts with appropriate voltage requirements.

At this temperature the contacts of relay 103 would be closed providing current to the diverting valve 323 by way of terminal block 131 contacts. Terminal blocks are used for easy installation providing a convenient means of connecting external field wiring to internal wiring, however, direct wiring may be used eliminating the terminal blocks if so desired. Activation of the diverting valves 323 would be indicated by a lamp 143. This lamp as well as the power on lamp should be rated 230 volt since the power to these are not through the transformer, and even though the source is only 208 volt, a 230 volt lamp is used for longer life. The other lamps indicating auxiliary heat on 141 and A.C. on 145 would be of a small voltage capacity since their power is directed from a low voltage source 309. Similarly, 28 volt rated lamps are used on 24 volt source for longer life. Further, since these lamps are for indicating purpose only, they do not affect the functioning of the system; they are optional and may be eliminated if so desired, or conveniently mounted remotely.

The function of the diverting valves 323, now activated, are to direct reclaimed heat from the A.C. or other refrigeration compressor units to heating coil to heat up the overcooled or normally cool air within the controlled environment. When this is not necessary the diverting valves would be deactivated allowing the heat to be dissipated the conventional way or reclaimed to be used for some other purpose, i.e. preheat water.

At times, however, depending upon the particular circumstances, auxiliary heaters 301 may be necessary when the reclaimed heat is insufficient and the temperature is below 68° F. The coordination of these heaters is provided by relay 101 and sensor switch 201, plus some simple wiring. The sensor switch 201 will insure that auxiliary heat is only supplied when the reclaimed heat is inadequate by being activated at a lower temperature, for example, below 68° F.

When the temperature is below 68° F. sensor 201 causes the contacts of relay 101 to close providing a complete circuit to the auxiliary heater. This heating activity would be indicated by lamp 141 which is now connected to the power source and at this point all available heat is on.

At 68° F. the sensor switch 201 will open. This is typical of all the sensor switches (on heat) which, normally closed, open when a predetermined temperature is reached.

Thermostat switching may be provided by a mercury column type switch of relatively low cost with high accuracy. An example of a preferred sensor which measures the temperature directly is an ACCUSTAT manufactured by PSG Industries, 1225 Tunnel Road, Perkasie, Pa. 18944. These are readily replaceable and accurate to ½° F. to the set temperature. If a different temperature setting is desired, it is easily accomplished by replacing the sensor.

Any standard humidistat, preferably adjustable and normally in the open position, may be used, possibly a Dew Point Controller by Honeywell Corp., Minneapolis Minn. 55408, Model #H409A, to provide similar switching.

Figure 2:
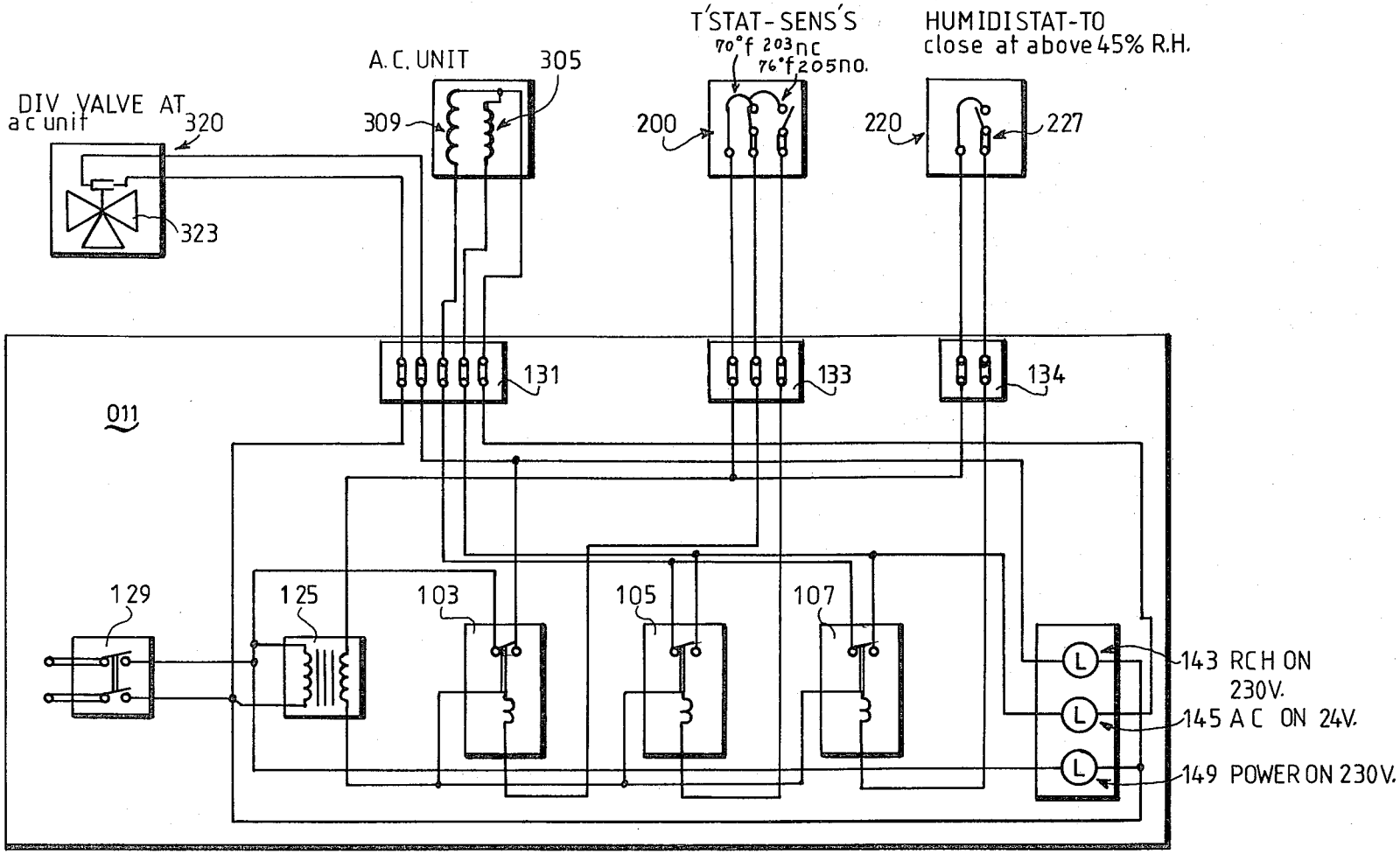
FIG. 2 is a schematic drawing of an environmental control system without auxiliary heat control and utilizing a control panel which incorporates the teachings of this invention.
Figure 3A:
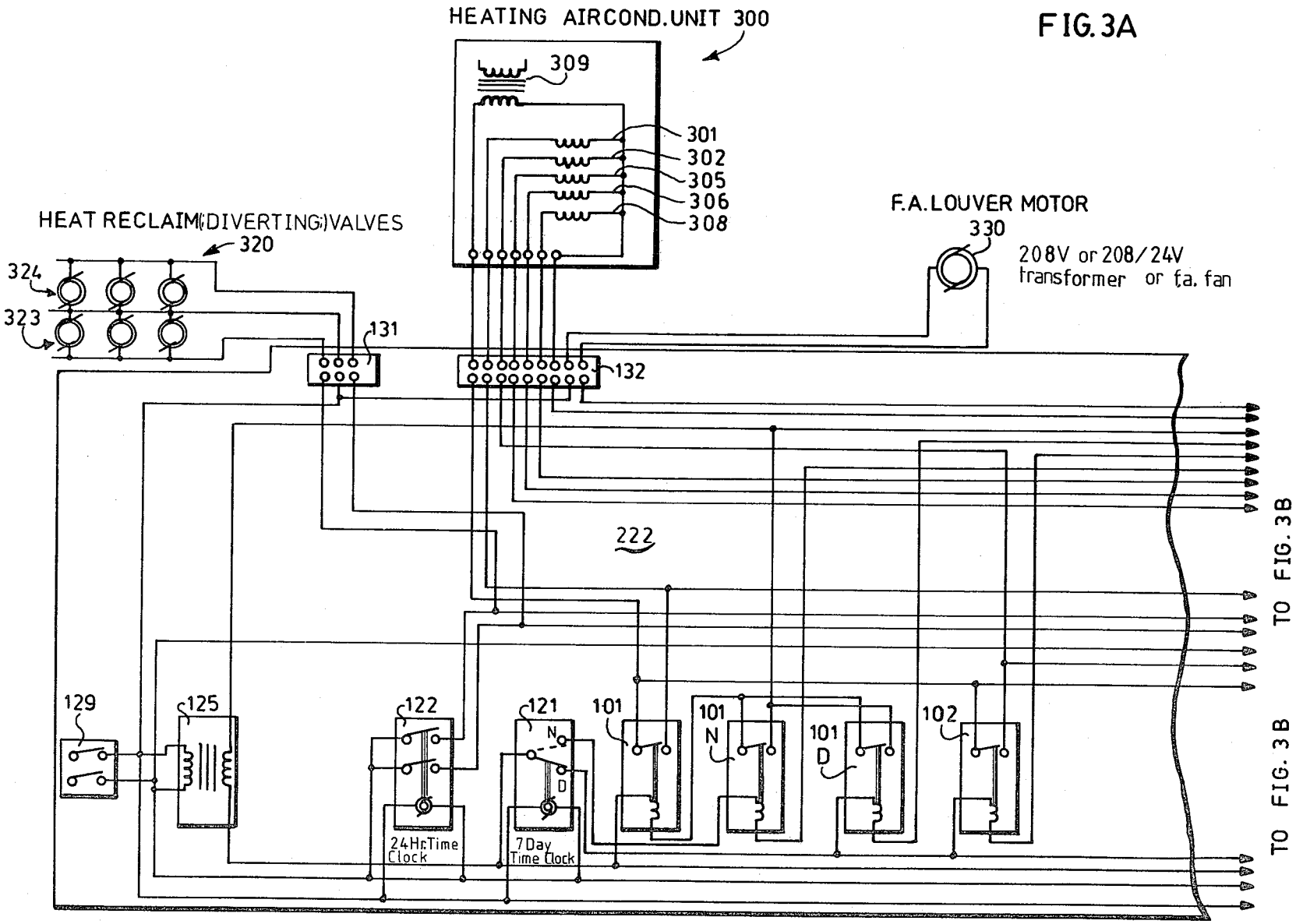
FIGS. 3A and 3B show a schematic drawing of an environmental control system utilizing a multistage (2 stage reclaim heat, 2 stage auxiliary heat, and 2 stage A.C., with night set back, supply fan control and fresh air) control panel incorporating the teachings of this invention.
Figure 3B:
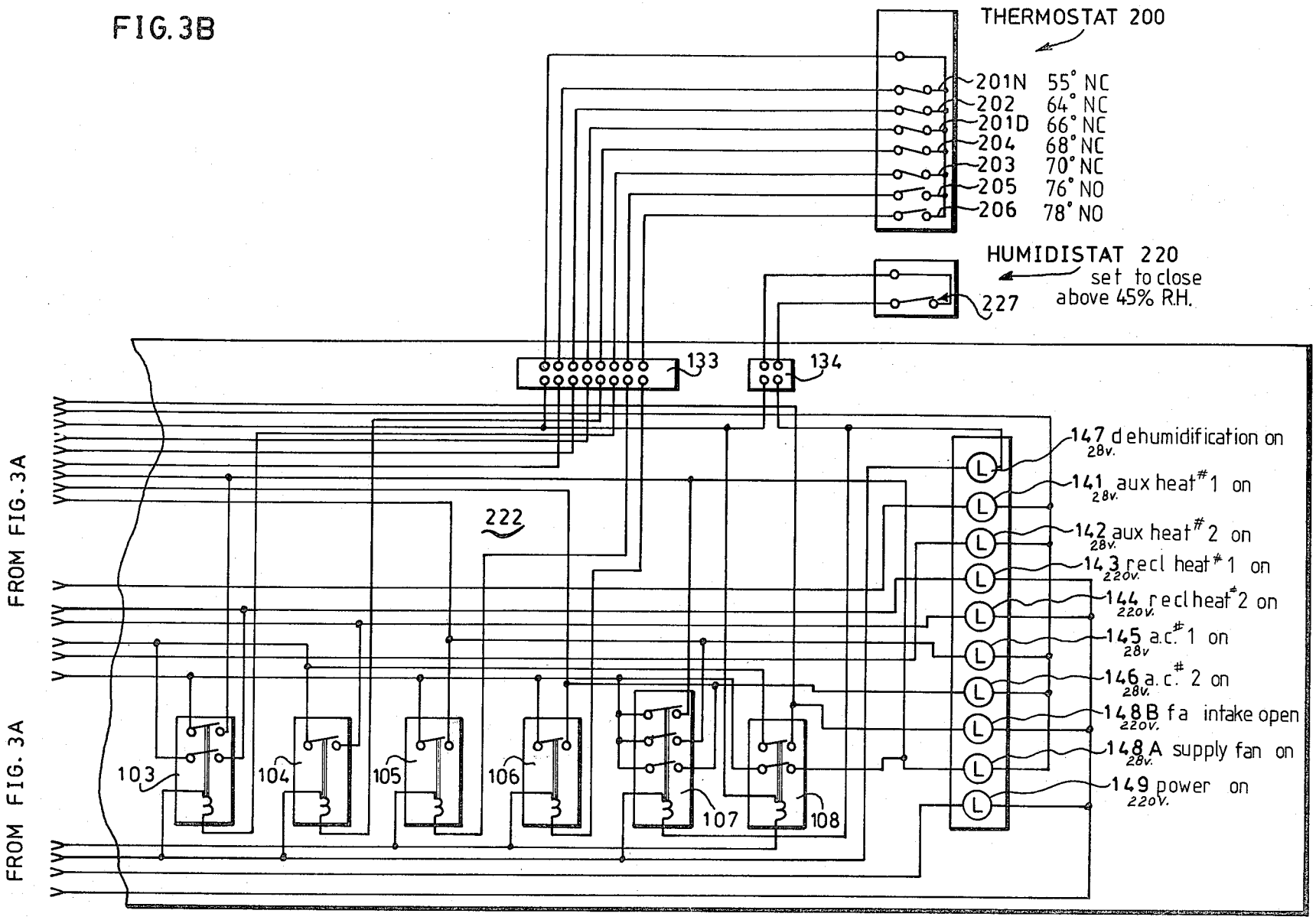

Since the sensors provide the working parameters of the system and may be readily replaced to react at different levels, the mere incorporation of these sensors allows the system to be used easily in many different situations, adjusted to the particular need or desire. Furthermore, the panel itself may be adapted for a simpler or more complex demand when necessary as shown in FIGS. 2 and 3 later discussed.

The opening of sensor switch 201 opens the circuit through coil of relay 101 by way of the contacts at terminal block 131. This deenergizes the coil opening the relay contacts which deactivates the auxiliary heaters 301 and extinguishing the indicator lamp 141.

As the temperature continues to rise and reaches 70° F. sensor switch 203 will open deenergizing the coil of relay 103 opening its contacts, stopping the current flowing to the diverting valves 323. Deactivation of the diverting valves 323 allows the reclaimed heat to be used for some other purpose rather than heating the air. Correspondingly, the lamp 143 which had indicated such activity is deactivated.

At this point of time there is no input of heat or cool air into the system and the indicator lamps will show only that the panel is activated. If the temperatures should rise to 76° F. then the sensor switch 205 will close. A path for current now exists from the transformer 125 through the coil of the relay 105. This will close the relay contact activating the A.C. 305 through terminal 131. Current would also be directed to the lamp 145 indicating that the A.C. unit was in operation. When the A.C. is on, a heat reclaiming means is harvesting the heat expelled by its compressor for use in heating the environment or any other desired purpose.

When the temperature goes below 76° F. the sensor switch 205 will open, deactivating the A.C. unit and extinguishing the indicator 145. If the temperature continues to fall and goes below 70° F. the sensor switch 203 closes, energizing the coil of relay 103, closing the contacts, which then activates the diverting valves 323 and the indicating lamp 143. Now the reclaimed heat is used to heat up the environment.

The auxiliary heaters are activated only when the temperature falls below 68° F. indicating that the reclaimed heat is insufficient to keep the temperature at the level of 68°–70° F.

If at any stage of the environmental control operation the humidity rises about setting point of 45% relative then the sensor switch 227 will close energizing the coil of relay 107 via terminal 134. The closing contacts will activate the A.C. and lamp 145. This by-passes the temperature controlled relay 105. The A.C. will stay on until the humidity level goes below setting point 45% relative at which time the switch 227 will open deactivating the coil and opening the contacts of relay 107 shutting off the A.C.

While the A.C. is operating now to remove humidity the temperature sensors are still active in regard to the relays coordinating the heaters. If the A.C. humidity reducing activity also results in reducing the temperature below 70° F. then at this time the diverting valves will use the reclaimed heat to increase the temperature of the overcooled air. Depending on the efficiency of the heat reclaiming means if the heat provided is insufficient and the temperature continues to drop then at 68° F. the auxiliary heaters will be activated. At this point the A.C. and the heaters are working to reduce the humidity while maintaining a comfortable environment.

Once the humidity drops below setting point 45% relative the switch 227 will open resulting in deactivating the A.C. and the panel will now operate in a manner dependent upon temperature as previously described.

Reference is now made to the embodiment of the invention as shown in FIG. 2. This is essentially a simpler version of the embodiment of FIG. 1 and accordingly, corresponding parts will be similarly numbered. The only essential difference between this embodiment and the one shown in FIG. 1 is that here the system does not utilize auxiliary heaters. In this regard, the coordinating relay, the added temperature sensor switch and indicator lamp are unnecessary. The remaining structure and operation is the same as that previously described for FIG. 1. The system utilizing the panel 011. may be used for dehumidification only in situations where the reclaimed heat introduced to the system is sufficient to heat up the over-cooled air so that a comfortable environment is maintained.

In addition, it may find application by supplementing an existing heating system regulated by its own thermostat. The two systems would work together in a manner similar to the system shown in FIG. 1 except the coordination of the auxiliary heaters would be independent of the panel 011.

Further in this regard are situations where humidity control is critical and temperature regulation secondary. This would arise in homes or businesses which are closed for a period of time. The primary object is to prevent mold or mildew which arises when there is excessive humidity and the need to quickly heat the cool or over-cooled air does not exist.

Also, should the system ever require the use of auxiliary heaters, by the simple addition of parts such a demand may be accommodated.

In regard now to FIG. 3, a multi-stage environmental control system with corresponding control panel 222 is shown. In many applications the activities of the system may be on a noncontinuous basis, time-sequenced to reduce performance in the evenings and on weekends. This is easily accomplished by the addition of a time clock 121 which, adjusted to the time parameters desired on a 7-day basis, would alternate the activities of the spring relays to produce day, night or weekend environments.

For further energy saving, the panel incorporates a switching system also actuated by time clock 121 to control a supply fan 308 and a fresh air louver motor 330 and/or supply fan. The fan 308 runs continuously during working hours moving air through the heating and/or air conditioning unit and through whatever duct work is necessary. Similarly, the fresh air louver motor 330 and/or supply fan operates during daytime providing a desired amount of fresh air during occupancy of the conditioned area. During night time or nonoccupied periods, fresh air is not necessary so the motor 330 is deactivated. The supply fan 308 is also deactivated at this time and is only activated as is necessary for heat and dehumidification purposes.

In addition, since the system incorporates diverting valves periodic flushing may be desirous to prevent build-up of oil in heat reclaim lines. This may be accomplished by a time clock 122 which may be adjusted in such a way that in every 24 hours for 15 minutes its contacts will close bypassing any regulatory relays, opening the diverting valves for flushing purposes.

Aside from the timing devices which are inexpensive and may supplement the prior embodiments, the control panel incorporates additional spring relays to provide for two auxiliary heat steps, two reclaim heat steps and two air cooling steps.

The operation of the panel and system can be readily seen and assume as a start point a temperature less than 64° F. and relative humidity below 45%. Turning the switch 129 on, 208 volts of alternating current enters panel 222 activating power on lamp 149 and energizes the 220/24 volt transformer 125 and both time clocks 121 and 122. Also at this time 208 volts flows through the contacts of relays 103 and 104 which would be closed, terminal block 131 and to diverting valves 323 and 324, opening valves thereby providing the system with reclaimed heat. Correspondingly, lamps 143 and 144 are activated to indicate that reclaimed heat is now being introduced into the system.

With the time clock 121 on a day switch setting as shown, 24 volts flow from the transformer 125 through the time clock contact D reaching the coils of relays 101D, 102, 105, 106 and 108, and through terminal block 133 reaching temperature sensor switches 201D, 202, 205 and 206. Switches normally closed, open: 201D at 66° F., 202 at 64° F., and those normally open, close: 205 at 76° F. and 206 at 78° F. Since the assumed existing room temperature is below 64° F., sensor switches 201D, 202 are closed and 205 and 206 are open.

In addition, a current of 24 volts is connected directly from the transformer to relays 101, 103, 104 and 107 holding coils reaching temperature sensors switches 203 and 204, sensitive to 68° F. and 70° F. respectively, and through terminal block 134 to humidistat switch 227. These sensor switches are in the closed position.

At this temperature, the closed contact of relay 101 provides a path for current, originating at an outside power source 309, to activate a first auxiliary heater 301 via terminal block 132. The closed relay 102 is activating a second auxiliary heater 302. This provides for both stages of auxiliary heating and corresponding indicator lamps 141 and 142 will reflect such activity. At this point of time, all available heat is on.

As the temperature rises to 64° F. sensor switch 202 opens. A path for current is now disrupted through the coil of relay 102. This deenergizes the coil of relay 102 which opens its contacts deactivating the second auxiliary heater 302 and lamp 142. When the temperature reaches 66° F. the sensor switch 201D will open disrupting current to pass through the coil of relay 101D opening its contacts which cuts off the current through relay 101 holding coil opening its contacts shutting off the first auxiliary heater 301 and lamp 141.

At 68° F. sensor switch 204 opens deenergizing the coil of relay 104, opening its contacts, deactivating the second group of diverting valves 324 and lamp 144. Similarly at 70° F. sensor switch 203 opens deenergizing the coil of relay 103 opening its contacts which deactivates the first group of diverting valves 323 and lamp 143. All heat is now in the off position.

The system will remain in inactive status (except supply fan 308 is running and fresh air is supplied) as long as the temperature remains between 70° F. and 76° F. and humidity below 45% relative.

If the temperature rises to 76° F. the sensor switch 205 will close energizing the coil of relay 105, closing its contacts allowing current to activate the first stage A.C. unit 305 and indicator 145. If the temperature raises to 78° F. switch 206 will close energizing relay 106 closing its contacts activating the second stage A.C. 306 and indicator lamp 146.

As the temperature declines the reverse of the prior activity will occur deactivating the A.C. and activating the diverting valves and auxiliary heaters according to the temperature sensors as necessary.

If the humidistat senses humidity above 45% relative the sensor switch 227 will close, energizing relay 107 closing its contacts, by-passing the contacts of relays 105 and 106. This forces both stages of air conditioning to dehumidify the environment with the temperature sensors stepping in heat automatically as required for reheat to comfort.

The time clock 121 may be adjusted for night and week-end regulation wherein at a set time contact 121 D will open and contact 121 N will close. The opening of contact 121 D locks out the auxiliary heater 302 and the A.C. units 305 and 306 but does not affect the activities of the diverting valves in providing reclaimed heat when the temperature goes below 70° F. Nor is the humidity sensor by-pass affected which will still activate the A.C. units when necessary.

The closing of contact 121 N provides a means of activating an auxiliary heater when necessary. The temperature sensor switch 201 N is open as long as the temperature is above 55° F. but will close if the temperature drops below 55° F. When this occurs current passes through the coil of relay 101 N, closing its contacts which in turn allows current to energize the coil of relay 101 closing the normally open contacts. If the contacts of relay 101 are open the auxiliary heater is off; if the contacts are closed the heater is on. The resulting effect is that if the reclaimed heater is unable to maintain a 55° F. temperature then auxiliary heat wil be used to maintain that temperature.

Relay 108 is used to control the supply fan 308 and will operate continuously when the time clock 121 is on a day setting to provide for proper pressurization of the environment and movement of air through the system. Also relay 108 has a second contact which controls the fresh air louver motor 330 providing the fresh air supply.

When the time clock 121 is on a night setting, the supply fan 308 will cycle automatically with the A.C. when it is activated to reduce the humidity. In this regard, during nighttime operation if the humidity is high, sensor 227 will close, energizing the coil of relay 107, closing its contacts, providing current to pass therethrough activating the A.C. units and the supply fan 304. Similarly, when the use of reclaimed heat is necessary on nighttime operation, relay 103 is provided with an additional contact cycling the supply fan with use of the reclaimed heat. This occurs when the temperature goes below 70° F. Sensor switch 203 is closed, energized relay 103 closing its contacts, activating the diverting valves 323 and supply fan 308.

Of course, as in the case of all sensors, the temperature levels necessary to close or open the switches were used merely as examples. Such sensors can be readily unplugged with new sensors plugged in as desired. In addition, if additional control steps are required the addition of a sensor and relay will provide for it as has been shown by the embodiments.

Although several somewhat preferred embodiments have been disclosed and described in detail herein, it should be understood that this invention is in no sense limited thereby and its scope is to be determined by that of the appended claims.

What is claimed is:

1. A system providing for temperature and humidity control of an environment comprising:

switching means for regulating a temperature control means including air cooling and air heating means, having a plurality of replaceable standard relays and associated contacts therefor with few moving parts;

a temperature sensor coupled with the switching means, and capable of activating the switching means and consequently the temperature control means at certain temperature settings including for heating, turning the heating means on below a certain temperature of the environment and off above a certain temperature, and for cooling, turning the cooling means on above a certain temperature and off below a certain temperature;

a humidity sensor responsive to moisture in air coupled with the switching means and capable of activating the switching means and consequently the temperature control means at a certain level of humidity for dehumidification by turning the cooling means on above a certain humidity level and off below a certain humidity level independently of the operation of the temperature sensor.

2. The invention in accordance with claim 1, wherein the temperature sensor includes a plurality of separate mercury column type switches, each switch capable of activating the switching means at a certain temperature.

3. The invention in accordance with claims 1 or 2, wherein the sensor responsive to moisture in the air is adjustable to different humidity level sensitivity.

4. The invention in accordance with claim 1 which includes the temperature control means.

5. A system providing for temperature and humidity control of an environment, comprising:

switching means for regulating a temperature control means including air cooling and air heating means operative to provide a plurality of stages of cooling and heating respectively;

said switching means having a plurality of standard replaceable relays and associated contacts therefor with few moving parts for sequentially regulating the operation of the stages of the cooling and heating means for temperature and humidity control;

a temperature sensor coupled with the switching means activating the switching means and consequently the temperature control means at certain temperature settings including, for heating, turning the heating means on below a certain temperature of the environment and off above a certain temperature, and for cooling, turning the cooling means on above a certain temperature and off below a certain temperature;

a sensor responsive to moisture in air coupled with the switching means, activating the switching means and consequently the temperature control means at certain humidity levels for dehumidification, turning the cooling means on above a certain humidity level of the environment and off below a certain humidity level;

a means of connecting the switching means, temperature control means, temperature sensor and sensor responsive to moisture in the air whereby the temperature control means actuated by the latter sensor operates to reduce the humidity and in doing so operates at a temperature below the temperature at which it would normally be shut off with the temperature control means being actuated to heat up the environment to a certain temperature.

6. The invention in accordance with claim 5, which includes the temperature control means.

7. The invention in accordance with claim 6, wherein the air heating means includes an auxiliary heater of any standard variety as one of its stages.

8. The invention in accordance with claim 6 or 7, wherein the air heating means utilizes a source of waste heat as one of its stages with said heating means coupled with the reclaimed waste heat.

9. The invention in accordance with claim 8, wherein the heat is reclaimed from the air cooling means or refrigeration units.

10. The invention in accordance with claim 8, wherein the system activates diverting valves for diverting waste heat to the air heating means for reclamation.

11. The invention in accordance with claim 10, wherein a time clock is provided and coupled with a means capable of controlling periodic flushing of said valves and lines attached thereto.

12. The invention in accordance with claim 5, wherein the temperature sensor includes a plurality of separate mercury column type switches each switch capable of activating the switching means at a certain temperature.

13. The invention in accordance with claim 5, wherein the sensor responsive to moisture in air is adjustable to set the level at which the switching means and consequently the temperature control means is activated and deactivated.

14. The invention in accordance with claim 5, including means controlling a supply fan for providing for movement of air within the environment, and, means for controlling the supply of fresh air in the environment.

15. A system providing for temperature and humidity control of an environment comprising:

switching means for regulating a temperature control means;

a temperature sensor including a plurality of separate mercury column type switches coupled with the switching means, each switch capable of activating the switching means and consequently the temperature control means by turning the temperature control means on below a selected temperature and turning the temperature control means off above a selected temperature for heating; by turning the temperature control means on above a selected temperature and turning it off below a selected temperature for cooling;

a sensor responsive to moisture in air coupled with the switching means activating the switching means and consequently the temperature control means at a particular selected humidity level by turning the temperature control means on above the selected level and turning it off when the selected humidity is reached;

a means of connecting the temperature control means, switching means, temperature sensor and sensor responsive to moisture in the air whereby the temperature control means, activated by the latter sensor, operates to reduce the humidity and in doing so operates at temperatures below a selected temperature at which it would normally be shut off with the temperature control means being activated to heat up the environment to a selected temperature.

16. The invention in accordance with claim 15, wherein the switching means includes a plurality of replaceable standard relays and contacts therefor with few moving parts for regulating the operation of the temperature control means to control the temperature and humidity of the environment.

17. The invention in accordance with claim 15, includes the temperature control means having an air cooling means and air heating means.

18. The invention in accordance with claim 17, wherein the air heating means includes an auxiliary heater of any standard variety.

19. The invention in accordance with claim 17 or 18, wherein the air heating means utilizes a source of waste heat and said means is coupled to reclaim the waste heat.

20. The invention in accordance with claim 19, wherein the heat is reclaimed from the air cooling means or refrigeration units.

21. The invention in accordance with claim 19, wherein the system activates diverting valves for diverting waste heat from the source of waste heat to the air heating means for reclamation.

22. The invention in accordance with claim 21, wherein a time clock is provided and coupled with a means of capable of controlling periodic flushing of the valves and lines attached thereto.

23. The invention in accordance with claim 15, wherein the sensor responsive to moisture in air is adjustable to set the level at which the switching means and consequently the temperature control means is activated and deactivated.

24. The invention in accordance with claim 18, wherein the air cooling means provides cooling in one or more stages and air heating means provides heating one or more stages.

25. The invention in accordance with claim 24, wherein the air heating means includes auxiliary heat and reclaimed heat with as many stages of each as desired.

26. The invention in accordance with claim 25 wherein a plurality of temperature sensors are provided, each temperature sensor is connected to a relay and the sensor responsive to moisture in air is connected to a relay and activates the relay independent of the temperature sensors.

27. The invention in accordance with claim 26 wherein at least one relay contact of a relay connected to a temperature sensor communicates with the air cooling means for each stage of cooling, at least one relay contact of a relay connected to a temperature sensor communicates with the air heating means for each stage of heating and at least one relay contact of a relay connected to the sensor responsive to moisture in air communicates with the air cooling means.

28. The invention in accordance with claim 27 wherein a time clock is provided and a means of connecting the time clock to the relays and contacts thereto so that periodically the system will only activiate the air heating means at a certain temperature and only activate the air cooling means when the humidity is at a certain level.

29. The invention in accordance with claim 28, wherein the means of connecting the time clock involves interrupting the communication between the sensors and the relays, allowing the reclaimed heat to maintain temperature, if reclaim heat is not sufficient a separate sensor will be activated on a lower setting point providing for auxiliary heat at a certain temperature normally below the comfort range, so as to conserve energy while also providing air cooling for humidity purposes on a consistent basis.

30. The invention in accordance with claim 15, including a supply fan providing for movement of air within the environment and means for supplying fresh air into the environment, each coupled with the switching means regulating the activities of same.

31. The invention in accordance with claim 30, wherein a time clock is provided and connected to the switching means whereby it periodically deactivates the supply fan and means for supplying fresh air, activating the supply fan only when air heating or air cooling activity takes place.

32. For use in an environment control system, a switching means capable of regulating activity of a temperature control means for temperature and humidity control based upon predetermined temperature and humidity levels sensed by temperature and humidity sensors; said switching means comprises:

a plurality of replaceable standard relays and associated contacts therefor with few moving parts with at least one relay for each level of temperature and capable of activating the temperature control means for cooling by turning the temperature control means on above a certain temperature level and off below a certain temperature level; and at least one relay for each level of humidity capable of activating the temperature control means for dehumidification, by turning the temperature control means on above a certain humidity level and off when a certain humidity level is reached independent of the temperature control means activity as regulated by the temperature sensor via the switching means.

33. The invention in accordance with claim 32, wherein the temperature control means includes an air cooling means and air heating means each having a plurality of stages of cooling and heating respectively, said switching means includes at least one relay for each stage of cooling and heating.

34. In combination with the invention according to claim 32 a time clock and means of connecting the relays to provide for periodic change in panel operation.

35. In combination with the invention according to claim 32 a time clock adapted to control periodic flushing of the air heating means when it utilizes heat reclaimed from the air cooling means or other refrigeration units.

36. In combination with the invention according to claim 32 a transformer adapted to communicate low voltage electricity to the holding coil of the relay.

37. In combination with the invention according to claim 32 a switch adapted to activate the panel.

38. In combination with the invention according to claim 33 a plurality of indicator lamp and means of connecting them to visually show what activity is transpiring.

* * * * *